US010538917B2

(12) United States Patent
Kinsella

(10) Patent No.: US 10,538,917 B2
(45) Date of Patent: Jan. 21, 2020

(54) SHOWER ENCLOSURE HEADER

(71) Applicant: Arrow Mirror and Glass, Inc., Houston, TX (US)

(72) Inventor: Joseph J. Kinsella, Dallas, TX (US)

(73) Assignee: Arrow Mirror and Glass, Inc., Houston, TX (US)

( * ) Notice: Subject to any disclaimer, the term of this patent is extended or adjusted under 35 U.S.C. 154(b) by 0 days.

(21) Appl. No.: 16/010,202

(22) Filed: Jun. 15, 2018

(65) Prior Publication Data

US 2018/0291625 A1 Oct. 11, 2018

Related U.S. Application Data

(63) Continuation-in-part of application No. PCT/US2016/067229, filed on Dec. 16, 2016.

(60) Provisional application No. 62/268,148, filed on Dec. 16, 2015.

(51) Int. Cl.
*E04C 3/28* (2006.01)
*A47K 3/28* (2006.01)

(52) U.S. Cl.
CPC ..... *E04C 3/28* (2013.01); *A47K 3/283* (2013.01)

(58) Field of Classification Search
CPC ..... E04C 3/28; A47K 3/283; A47K 3/30
See application file for complete search history.

(56) References Cited

U.S. PATENT DOCUMENTS

| | | | | |
|---|---|---|---|---|
| 4,114,597 | A * | 9/1978 | Erb | F24S 80/30 126/665 |
| 4,152,789 | A * | 5/1979 | Heath | A47K 3/284 4/611 |
| 4,856,126 | A * | 8/1989 | Baus | A47K 3/36 4/607 |
| 7,877,825 | B1 * | 2/2011 | Marshall | A47K 3/30 4/612 |
| 9,737,174 | B2 * | 8/2017 | Wei | A47K 3/34 |
| 9,737,175 | B2 * | 8/2017 | Wei | A47K 3/34 |
| 9,743,809 | B1 * | 8/2017 | Shaukat | A47K 3/34 |
| 10,202,797 | B1 * | 2/2019 | Header | E06B 3/5409 |
| 10,221,564 | B2 * | 3/2019 | Mei | E04B 2/7416 |
| 2004/0159049 | A1 * | 8/2004 | Teubert | A47K 3/30 49/505 |
| 2008/0022452 | A1 * | 1/2008 | Lock | A47K 3/284 4/614 |

(Continued)

FOREIGN PATENT DOCUMENTS

| | | |
|---|---|---|
| FR | 2 277 963 A1 | 2/1976 |
| WO | WO 9305261 A1 | 3/1993 |

OTHER PUBLICATIONS

PCT International Search Report; dated Jul. 6, 2017; PCT/US2016/067229 dated Jul. 6, 2017; pp. 1-10; International Searching Authority; Alexandria, VA; US.

(Continued)

*Primary Examiner* — Paola Agudelo
(74) *Attorney, Agent, or Firm* — Carrington, Coleman, Sloman & Blumenthal, L.L.P.

(57) ABSTRACT

Apparatus for retaining a glass panel, comprising: an anchor member for attaching to a wall and including a channel into which an edge of the glass panel will extend and a header member for fitting into abutment to the anchor member and including a channel for retaining an edge of the glass panel.

20 Claims, 8 Drawing Sheets

(56) References Cited

U.S. PATENT DOCUMENTS

| | | | | |
|---|---|---|---|---|
| 2012/0060420 | A1* | 3/2012 | Johnson | A47K 3/281 49/70 |
| 2013/0333847 | A1* | 12/2013 | Casseri | E06B 9/24 160/90 |
| 2014/0115773 | A1* | 5/2014 | Wei | A47K 3/30 4/607 |
| 2014/0250795 | A1* | 9/2014 | Wei | A47K 3/30 49/505 |
| 2016/0206156 | A1* | 7/2016 | Smith | A47K 3/284 |

OTHER PUBLICATIONS

European Patent Office; supplementary European search report; dated Jul. 26, 2019; App. No. 16876792.9-1005/3389459.

* cited by examiner

SHOWER ENCLOSURE HEADER

CROSS-REFERENCE TO RELATED APPLICATIONS

This application claims priority to, the benefit of the filing date of, is a continuation-in-part of, and hereby incorporates herein by reference, PCT International Patent application PCT/US2016/067229, which designates the United States, among other States, and is entitled "SHOWER HEADER ENCLOSURE" and was filed Dec. 16, 2016.

The above priority-claimed PCT International Patent application PCT/US2016/067229, claims priority to, and the benefit of the filing date of, U.S. provisional patent application 62/268,148, entitled "SHOWER HEADER ENCLOSURE" and filed Dec. 16, 2015.

STATEMENT REGARDING FEDERALLY SPONSORED RESEARCH OR DEVELOPMENT

Not Applicable.

BACKGROUND

The preferred embodiments relate to glass enclosures such as showers and more particularly to an improved header for such enclosures.

Traditionally, when installing a frameless glass shower enclosure consisting of, for example ¼" thickness glass or less, a stiffening header is utilized along the full length and upper sides of the top edge of the enclosure. Such a header 10 is shown in a prior art FIG. 1 in an exploded view, along with related items. The header 10 is made of extruded aluminum that is color treated to match the hinge and handle hardware that is utilized on the shower door. The header typically includes a longitudinal (i.e., along its length) channel 12 that is typically ½ inch wide and is for receiving the edge of the glass, as well as stiffening members 14 and 16, where the stiffening members 14 are slightly longer than the stiffening members 16, that protrude 90 degrees from the header inner walls into the channel 12, so as to cooperate with vinyl seals 18 that are later placed between each upper side of the glass and the stiffening members. When installing the header 10, the header 10 is placed over the top edge of the glass and secured to the glass by the use of the continuous length vinyl seals 18 that are forcibly inserted on each side of the glass, so as to fit between the glass and the stiffening members 14 and 16. To further secure the header, a screw hole is drilled from above the header at a location near the end of where that header, and the glass panel below it and in the channel, meets the shower wall, at a 45-degree downward angle, through the top edge and into the shower wall. In this regard, a typical header may be 1⅛" tall, so there is some clearance (e.g., ⅜") above the glass once it is inserted into the channel 12, thereby providing clearance also so that the screw may be located through the hole in the top of the header and into the wall, without interfering with the top of the glass in the channel. Hence, the screw length as it passes through the header and into the wall is co-planar with the plane of the glass below it. Note also that the above steps are typically a two person operation, as one person is required to hold the pane of glass in position, while the other positions the header atop the glass (typically also requiring a ladder to be at or even above the glass height), and then drills the 45 degree angle hole through the header top and into the shower wall surface, including any treatment on that wall (e.g., tile). A screw is then threaded through the header 10 and into the wall, where the screw may be secured snuggly into the tile with the screw entering a typical wall anchor that is located in the hole previously drilled from atop the header 10. The final step in the header installation process is the insertion of a snap filler 20 that is snapped into the channel over the location of the door, typically so as to fill the channel 12 above the door so as to block it from sight, such as from an angle or perspective below the header looking up at it, from either side of the door. Lastly, note that to create corners (e.g., 90 degrees), the prior art also includes an insert 22 that fits within a shelf 24 along the top of the header, that is, two pieces of header are cut at angles (e.g., 45 degrees) so as to join together to combine the desired corner angle, and the inset 22 is then placed within the shelf 24 of each header piece, as the respective angled ends of each of the two header pieces are brought together so as to capture the insert 22 between both pieces.

There are a number of issues related to the aluminum header and its installation procedure that are problematic. The following are examples: (1) inserting the vinyl will misalign the glass panels; (2) the holes drilled at an angle through the header and into the wall, for mounting via a diagonally-positioned screw, cause tile issues and are very difficult to achieve; (3) a ladder is required to properly install the diagonal screws; and (4) the snap filler creates metallic noises as the door is opened and closed. Thus, while the above approach has been used extensively and with some level of success in the glass shower industry, the present inventor has recognized long felt but unresolved drawbacks with the prior art approach, and such issues are improved with the preferred embodiments, described below.

BRIEF SUMMARY

In one preferred embodiment, there is an apparatus for retaining a glass panel. The apparatus includes an anchor member for attaching to a wall and including a channel into which an edge of the glass panel will extend. The apparatus also includes a header member for fitting into abutment to the anchor member and including a channel for retaining an edge of the glass panel.

Other preferred embodiments and aspects are described and claimed.

BRIEF DESCRIPTION OF DRAWINGS

The preferred embodiments will be described in detail below by referring to the accompanying drawings.

DETAILED DESCRIPTION OF EMBODIMENTS

Figure 1:
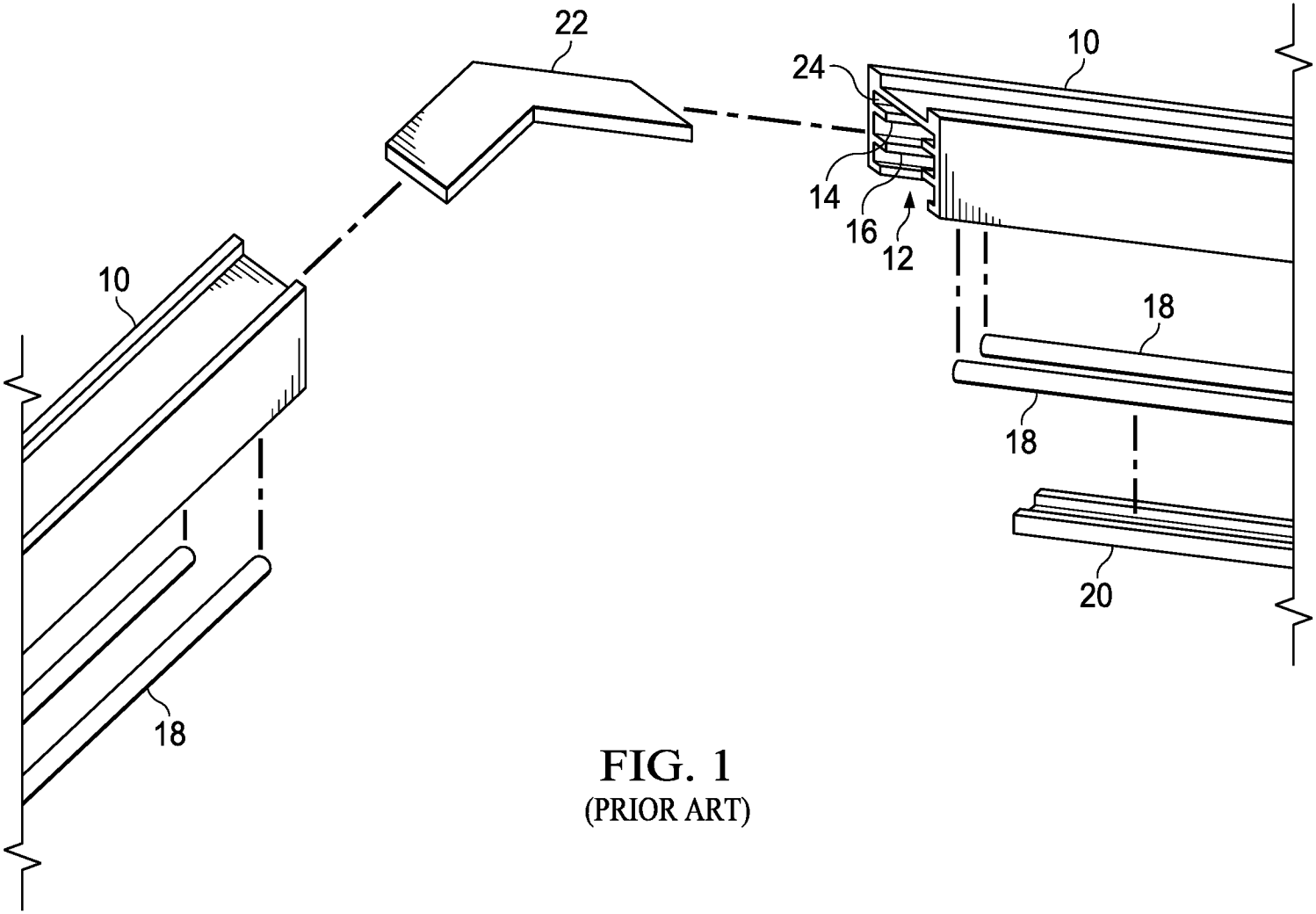
FIG. 1 (PRIOR ART)
FIG. 1 illustrates an exploded view of a prior art header 10, along with related items.

FIG. 1 was described above in the Background of the Invention section of this document and the reader is assumed to be familiar with that discussion.

Figure 2:
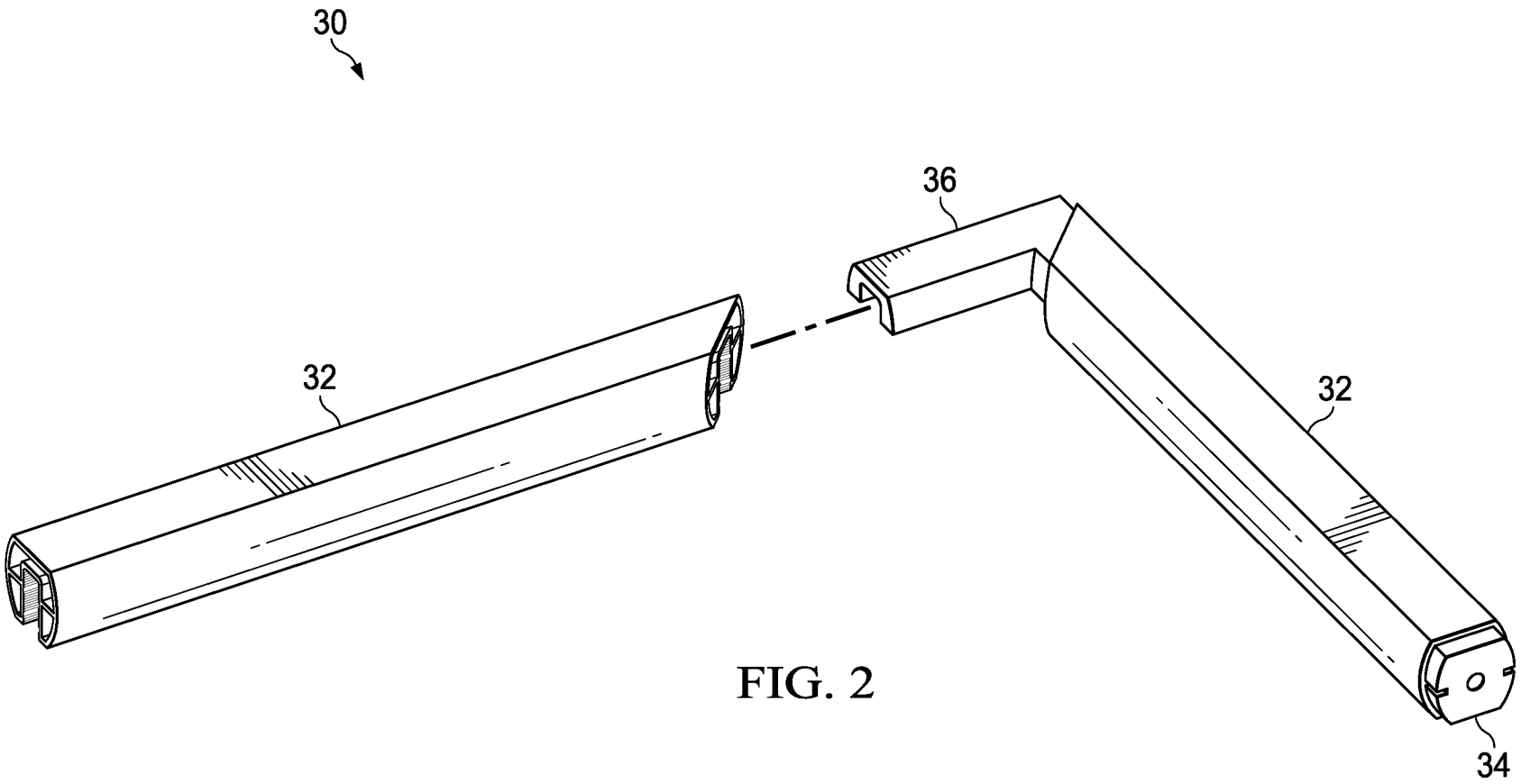
FIG. 2 illustrates a preferred embodiment header system, including header members 32 that work in conjunction with an end piece wall anchor 34 and an angle joining member 36.
Figure 3:
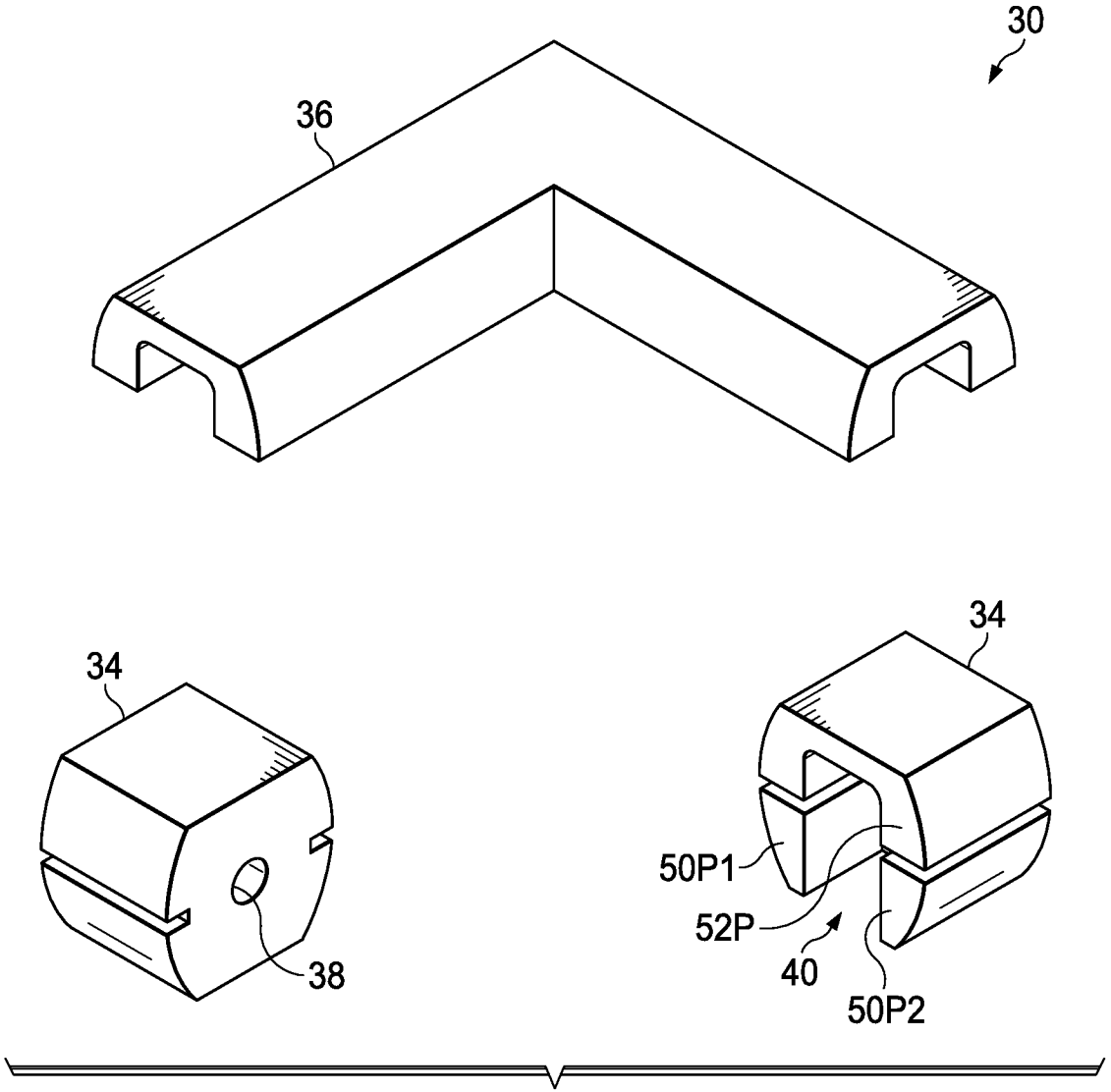
FIG. 3 illustrates parts of the system of FIG. 2 separated from one another, with both a front and rear perspective of the end piece wall anchor 34.

The preferred embodiment provides a header system for use with glass panels, as preferably implemented to create a shower enclosure. As shown in FIGS. 2 and 3, the preferred embodiment header system 30 includes header members 32 that work in conjunction with an end piece wall anchor 34 and, when multiple glass panels are to be installed that are not co-planar, also an angle joining member 36. Each header member 32 is preferably 1 inch wide and ⅞ inch tall, where the latter dimension may be contrasted with a typical prior art metallic header that is 1⅛ inch tall, so the preferred embodiment is preferable to various consumers as the profile reduction is appealing. Further, the length of each header member 32 is determined to approximately match the length of the edge of glass to which the header member 32 will attach, such to some variation for any corner as well as mating with the end piece wall anchor 34, as discussed below. Still further, in a preferred embodiment the material (s) of header member 32 may be something other than metal as, indeed, metal can unnecessarily increase costs, particularly in view of increased costs, such as tariffs, that are otherwise associated with certain imported extruded aluminum; hence, in this regard and others, a preferred embodiment material for members 32 is coated polycarbonate. Lastly, each header member 32 is preferably color coated to match the hardware used in combination with a shower system, that is, with the glass that is held in place in part by header system 30.

FIG. 2 illustrates the system 30 in partial assembly, while FIG. 3 illustrates parts of the system 30 separated from one another, with both a front and rear perspective of the end piece wall anchor 34. For installing the preferred embodiment, generally an end piece wall anchor 34 is installed onto a wall where the shower is to be formed, by securing a fastener (e.g., screw) through the hole 38 at an endwall of the wall anchor 34. Note that endwall of the wall anchor 34 is generally perpendicular to the length of the rest of the anchor 34, so the wall anchor 34 endwall can be placed against the shower wall, and a marking made through the hole 38, or a drill bit may be passed directly through the hole 38; hence, the screw through hole 38, and any preceding pilot hole, if desired, is drilled and located at a 90 (or approximately, such as within 15 degrees thereof) degree angle relative to the shower wall, that is, an angle much closer to 90 degrees as compared to the 45 degree angle required in the prior art; thus, the preferred embodiment provides a much easier and less error-prone drilling procedure as compared to the prior art, and it also eliminates the need for a ladder, as the drilling is accomplished first to install the end piece wall anchor 34, before the glass is in place and without the need to be above the top horizontal edge of the glass.

Once the end piece wall anchor 34 is affixed to the wall, the upper edge of the glass panel is located in the channel 40 of the end piece wall anchor 34. Thereafter, a header member 32, which also has a channel 42 on its underside (shown below), is fitted downward so that the header member channel aligns with the upper edge of the glass, and angled protruding stiffening members (shown below) within the header member channel rest against both upper sides of the glass, while an open end of the header member 32 slides along, abuts with, and slides over and thereby envelops a majority of the end piece wall anchor 34, as shown in part in FIG. 2; in a preferred embodiment, an outer surface of wall anchor 34 also includes a mechanism, such as a friction fitting retention surface, as may be implemented with an inclined surface treatment as detailed later, whereby once the header member 32 is slid over the wall anchor 34, there is resistance to pulling the two items back apart. Moreover, a second header member 32 may be adjoined a first one, through use of an angle joining member 36, which for illustration is shown as a 90 degree member, and whereby each header member 32 has an angled cut at its end (e.g., with a 45 degree miter edge to each member) so as to create a total of n abutting 90 degree completed junction where the two pieces come together. Like the outer surface of wall member 34, also preferably both ends of the angle joining member 36 also include a friction fitting retention surface, such as an inclined surface treatment, whereby once the header member 32 is slid over each end of the angle joining member 36, there is resistance to pulling the two items back apart. Note also that while FIG. 2 illustrates a 90 degree coupling between two header members 32 via an angle joining member 36, other angles are contemplated other than 90 degrees, although such adjustments, particularly in large bulk numbers as would be expected for large scale production and marketability, may prove to be time and cost prohibitive, but also would nonetheless require cutting corresponding angled edges of the header members 32 to match the non-90 degree angle of such a member 36. Additional illustrations of these and other variations of these aspects are further explored below.

Figure 4:
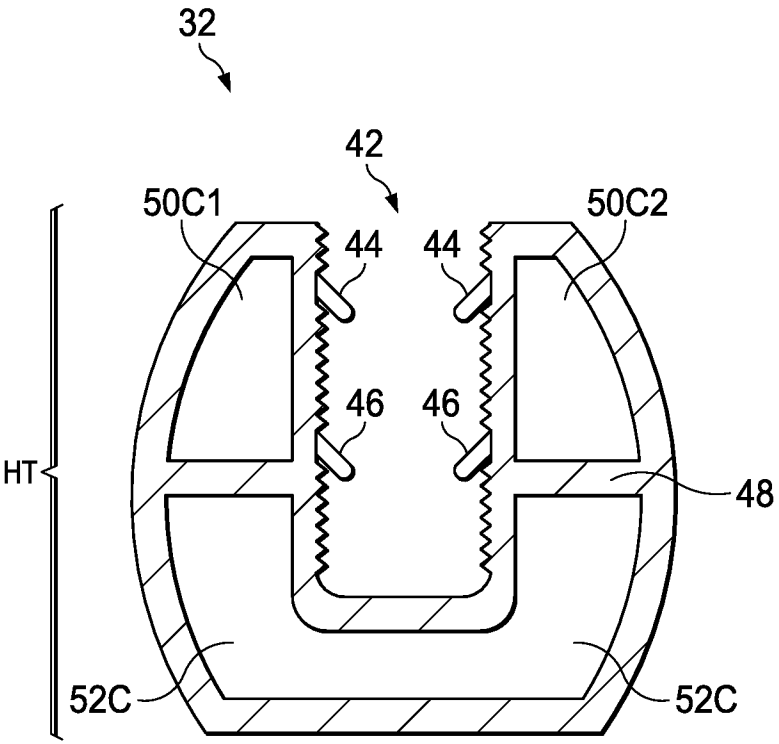
FIG. 4 illustrates a cross-sectional end view of a header member 32.

FIG. 4 illustrates a cross-sectional end view of a header member 32, as may further demonstrate aspects introduced above. From the illustrated view, the channel 42 in the header member 32 is clearly visible, and preferably it is considerably narrower than that of the prior art, where the prior art is typically ½ inch and the preferred embodiment width of the channel 42 is ¼ inch. Also visible in the view of FIG. 4 are that preferred embodiment header member further includes paired angled stiffening members 44 and 46, extending inward approximately 1/16 inch and at an acute upward angle relative to the inner walls and point of entry of the glass into the channel 42, where stiffening members 44 and 46 preferably extend along the inner walls of the channel 42 and parallel to the entire length of the header member 32. In a preferred embodiment, stiffening members 44 and 46 are integral to, and molded into, the header member channel 42 and are of a different density as to be flexible so as to accept the glass into the channel and abutting the stiffening members 44 and 46. Thus, these stiffening members 44 and 46 are for gripping the glass firmly when the glass edge and upper sides are positioned in the channel 42, thereby eliminating the prior art need for vinyl seals and also permitting the channel 42 to be relatively narrower than the prior art, as the latter also must accommodate the additional vinyl seals. In addition, a shelf 48 is shown as a member that approximately bisects the overall height HT (e.g., ⅞ inch) of the header member 32, although the shelf 48 does not extend within the channel 42, yet is approximately 15/16 inch wide. Shelf 48 thereby defines a first set of cavities 50C and a second set of cavities 52C, where in the example of FIG. 4 the first set of cavities 50C includes two cavities 50C1 and 50C2 and the second set of cavities 52C includes a single cavity. The cavities 50C and 52C provide respective receiving areas for receiving the ends of the end piece wall anchor 34—specifically, returning to FIG. 3 and the depiction of the end piece wall anchor 34 to the right, note that it has prongs 50P1, 50P2, and 52P, where the numbers of "50" and "52" in both FIGS. 3 and 4 illustrate the correspondence that the end piece wall anchor 34 of FIG. 3 mates to the header member 32 of FIG. 4, with the prongs 50P1 and 50P2 fitting into the cavities 50C1 and 50C2, respectively, and the prong 52P fitting into the cavity 52C. In this way, after the end piece wall anchor 34 is attached to a wall as described above, the header member 32 is slid into an abutting and enveloping relationship with the anchor 34, as shown in FIG. 2, while at the same time both the channel 42 under the header member 32 and the channel 40 of the end piece wall anchor 34 are aligned along the sides of the upper edge of the glass. Recall also from FIG. 2 that two pieces of the header member 32 may be brought together to form a corner (or other non-90 degree joint) above two pieces of glass abutting in a non-planar fashion, and note now that such an angle joining member 36 also fits relative to the shelf 48 of the header member 32. Lastly, note that with the narrower channel 42 of the preferred embodiment, there is a reduced aesthetic need to include a channel snap filler above the shower door, also as a benefit as compared to the prior art.

Figure 5:
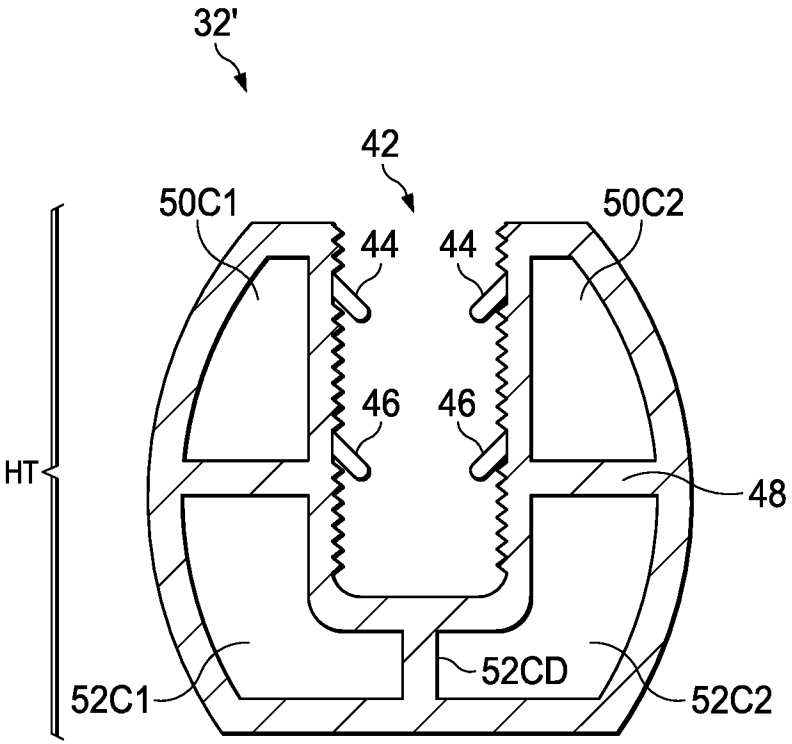
FIG. 5 illustrates a cross-sectional end view of an alternative preferred embodiment header member 32'.

FIG. 5 illustrates a cross-sectional end view of an alternative preferred embodiment header member 32', as compared to header member 32 shown in FIG. 4. Where like items appear in both figures, like reference numbers are used. However, for member 32', it includes an additional cavity divider 52CD. As shown in later figures, in a preferred embodiment, cavity divider 52CD extends along a majority, or the entirety, of the length and on the interior of member 32. In this regard, therefore, recall that the second cavity set 52C includes a single cavity in FIG. 4, whereas in FIG. 5 cavity divider 52CD divides the second cavity set 52C from FIG. 5 into two different cavities, shown in FIG. 5 as cavities 52C1 and 52C2. The addition of cavity divider 52CD is preferable in some or many implementations, as it provides additional structural support to member 32, particularly for lengthy runs, so that the member 32 does not twist or otherwise distort in shape as it spans along the edge of a piece of glass. With the addition of cavity divider 52CD, however, in this alternatives preferred embodiment modifications are also made to anchor member 34 and angle joining member 36, so as to facilitate the same slidable (and preferably corresponding) friction fit relationships described above, so as to accommodate the presence of cavity divider 52CD.

Figure 6:
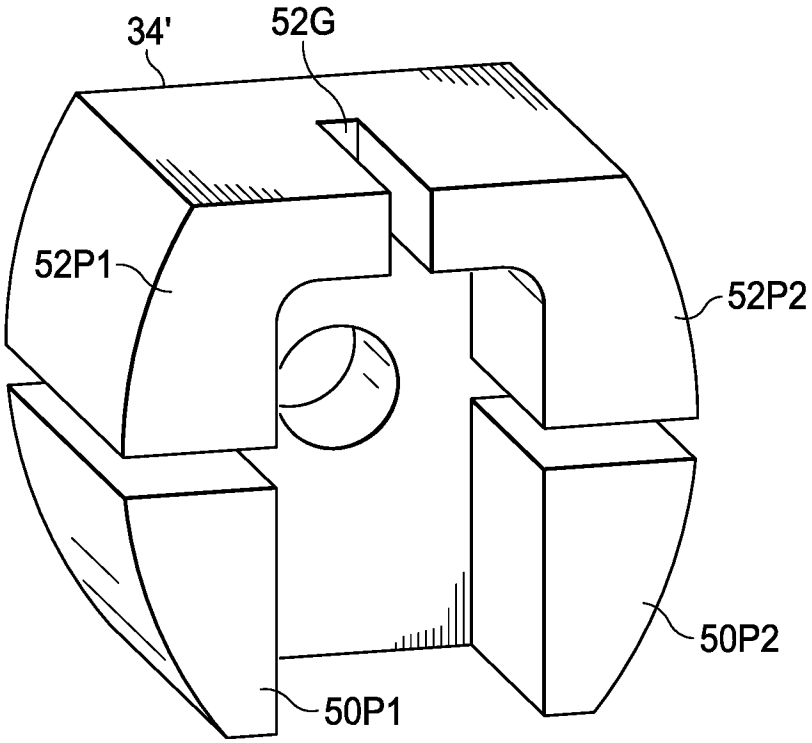
FIG. 6 illustrates a perspective view of an alternative preferred embodiment anchor 34'.

FIG. 6 illustrates a perspective view of an alternative preferred embodiment anchor 34', so as to cooperate with the alternative preferred embodiment header member 32' of FIG. 5. Where like items appearing in FIGS. 6 and 3, like reference numbers are used. However, for anchor 34', it includes two prongs 52P1 and 52P2, so as to friction fit within respective cavities 52C1 and 52C2, shown in FIG. 5. Thus, prongs 52P1 and 52P2 are separated by a gap 52G that thereby accommodates the cavity divider 52CD of anchor 34' (see FIG. 5).

Figure 7:
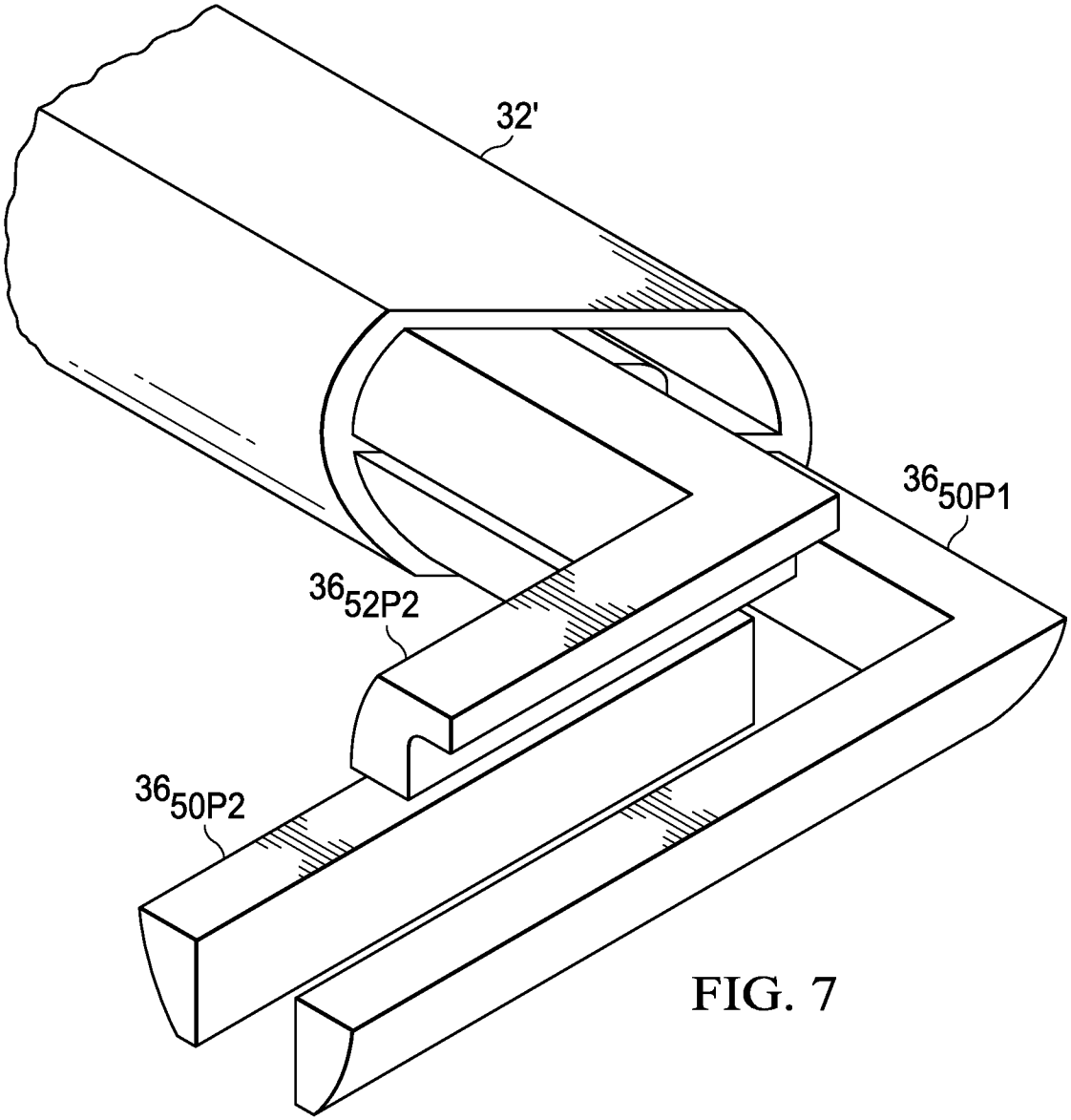
FIG. 7 illustrates a perspective view of the alternative preferred embodiment header member 32' shown in cross-sectional view in FIG. 5.

FIG. 7 illustrates a perspective view of the alternative preferred embodiment header member 32' shown in cross-sectional view in FIG. 5, along with three angle joining members $\mathbf{36}_{52P2}$, $\mathbf{36}_{50P1}$, and $\mathbf{36}_{50P2}$, partially inserted into the end of respective cavities of header member 32'. Thus, each angle joining member has a change in angle so as to facilitate the attachment of two header members as described earlier, where again in the example of FIG. 7 the angle is 90 degrees. For assembly of two such header members, therefore, one end of each angle joining member is fit into a cavity in one header member, after which the opposing end of each angle joining member is fit into a cavity in another header member, whereby each header member is slid to fully cover from visibility the angle member and to bring one header member into abutment with the other header member, so as to form a corner or other angle that matches the glass that is, or will be, fitted below each of the two header members. Note that FIG. 7 illustrates three angle joining members $\mathbf{36}_{52P2}$, $\mathbf{36}_{50P1}$, and $\mathbf{36}_{50P2}$, by way of example, so as to not unduly obscure the perspective view. However, in actual assembly, four such angle joining members may be used. In an alternative preferred embodiment assembly method, however, it may be plausible to use only two such angle joining members, thereby filling only two cavities near the emend of the two header members to be abutted to one another, while leaving the remaining two cavities of each abutting header member vacant; indeed, further in this regard, it is contemplated that use of two joining members in this regard will be sufficiently supportive for structural integrity, while reducing the number of parts (and associated labor) in joining header members to an angle. Moreover, when only two such joining members are used in this method, it is further preferably that they are in non-adjacent cavities, for example, by putting one in the upper left cavity and the other in the lower right cavity while leaving the upper right cavity and lower left cavity vacant, or alternatively by putting one in the upper right cavity and the other in the lower left cavity while leaving the upper left cavity and lower right cavity vacant.

Figure 8:
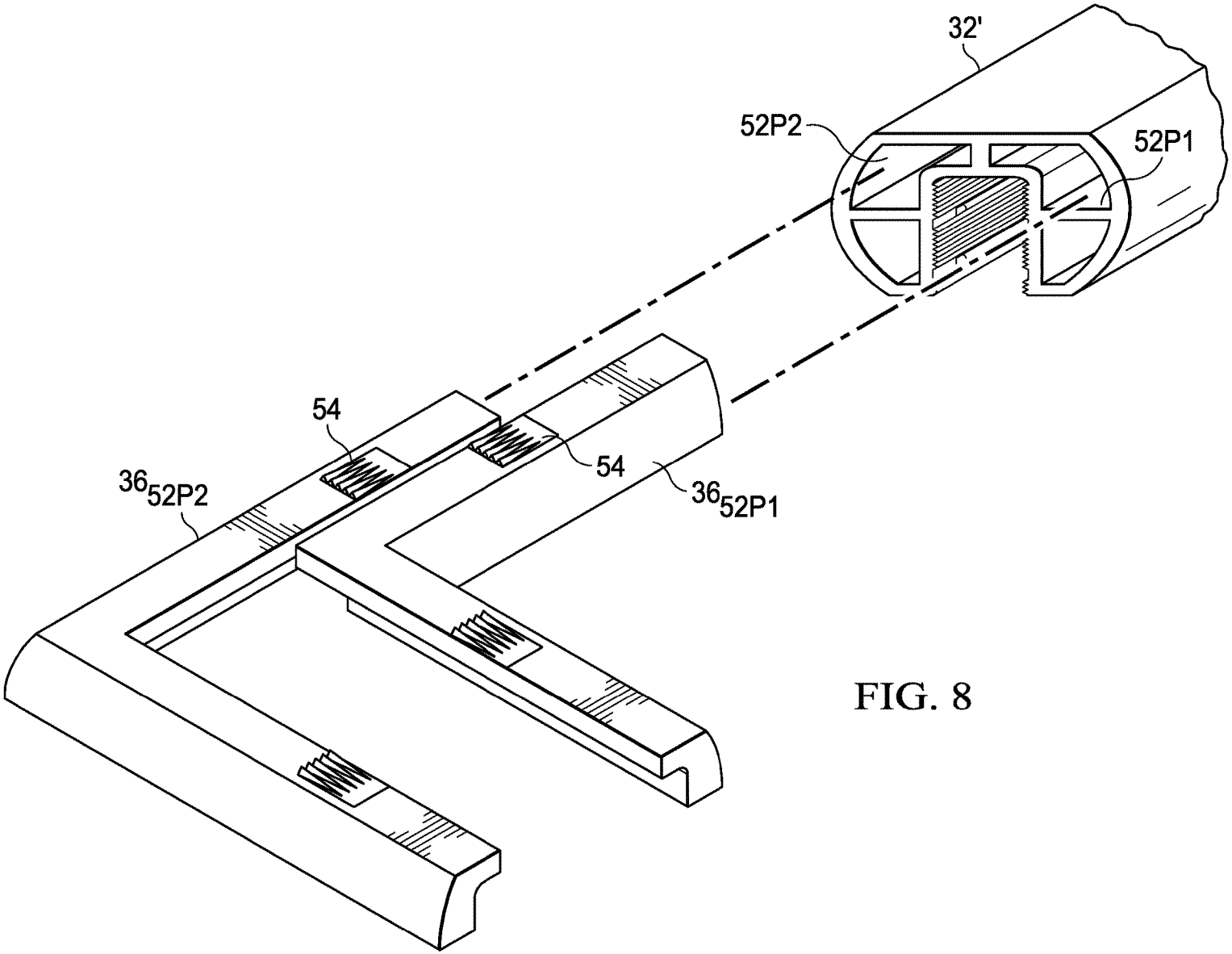
FIG. 8 illustrates an exploded view of the alternative preferred embodiment header member 32' shown in FIG. 7.

FIG. 8 illustrates an exploded view of the alternative preferred embodiment header member 32' shown in FIG. 7, along with two angle joining members $\mathbf{36}_{52P1}$ and $\mathbf{36}_{52P2}$. The exploded view further demonstrates how an end of each of the angle joining members $\mathbf{36}_{52P1}$ and $\mathbf{36}_{52P2}$ is for inserting into a respective cavity 52P1 and 52P2. Also in the view of FIG. 8, it may be seen that each angle joining members $\mathbf{36}_{52P1}$ and $\mathbf{36}_{52P2}$ also preferably included a mechanism 54, for example a friction fitting retention surface treatment or structure, where in the illustrated example the surface includes an inclined base that increases in height and from which a number of teeth members are formed, relative to the upper surface of the joining member, and in a direction away from the end of the joining member to be inserted into a respective cavity. Thus, as the end of the joining member is inserted into a respective cavity, additional retention force is created as the cross-section of the joining member generally mates with the inner walls of the respective cavity, while the mechanism thereby further increases the retention in that additional compression force is created due to its added volume being forced into the inner volume of the cavity. As a result, once the surface treatment mechanism 54 enters the cavity of header member 32, member 32 is slid over the joining member, there is additional resistance to pulling the two items back apart. Note also that the surface treatment of FIG. 8 also may be used with the above-described anchors 34 and 34'.

Figure 9:
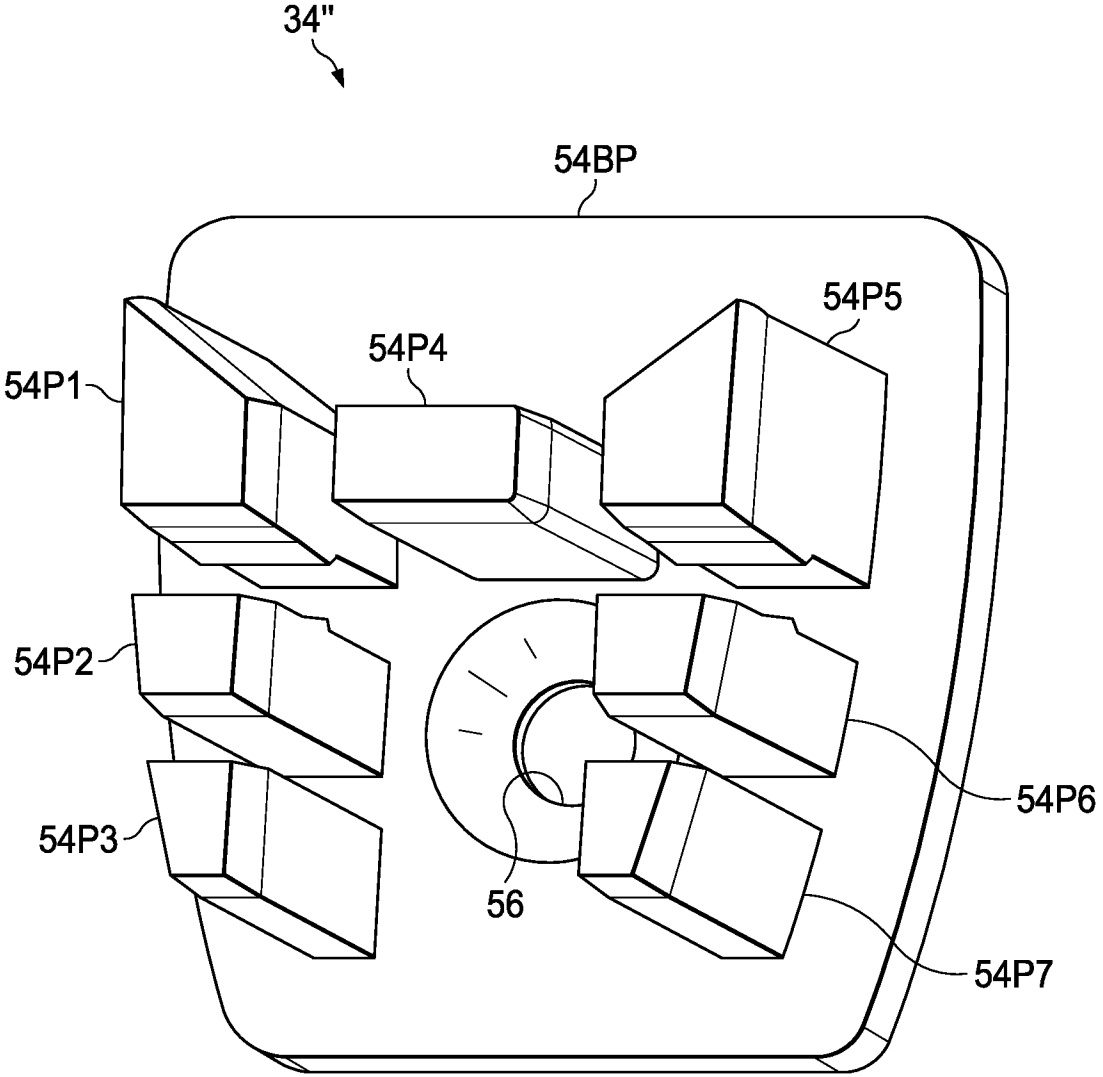
FIG. 9 illustrates a perspective view of an alternative preferred embodiment header member 34".

FIG. 9 illustrates a perspective view of an alternative preferred embodiment wall anchor 34". As with other preferred embodiment wall anchors described above, wall anchor 34" again includes a surface for abutting against a wall, which in the illustration of FIG. 9 is the backside of what is shown as a base plate 54BP, again with a center hole 56 through the base plate so that a screw (or other fastener) may be fit through the hole so as to attach anchor 34" against the wall.

Also as with other preferred embodiment wall anchors described above, wall anchor 34" includes a plural number of protrusions; thus, where earlier preferred embodiments provided either three or four such protrusions, as another example, anchor 34" includes additional protrusions, for a total of seven protrusions (shown as 54P1 through 54P7). Each protrusion will preferably mate with a respective cavity on a header member, comparable to those described earlier, but here that has been modified according to match the shape and location of each illustrated protrusion, and between some of the protrusions is a channel, akin to channel 40 described earlier, whereby the glass can fit between some of those protrusions, where in FIG. 9 that area is below protrusion 54P4, and between protrusions 54P2 and 54P3 to the left, and 54P6 and 54P7 to the right. Further, the additional protrusions can accommodate additional cavities, which exist by changing the interior structure of the above-described header member that had three or four such cavities, where to match anchor 34" a comparable header member may have additional horizontal (or other direction) interior walls, thereby strengthening the interior, for example, or supporting a header member with a larger cross-sectional area. In any event, therefore, in a preferred embodiment, anchor 34" is attached to a wall, and then a respective header member is advanced toward anchor 34" so as to couple the two together, with the protrusions fitting within the interior (cavities) of the header member, the glass fitting in both the header channel and the anchor piece channel and whereby the end of the header thus can contact the base plate 56 and leave a slight gap between the wall and end of the header member (and the same with the edge of the glass), with the distance of that defined by the thickness of the base plate (e.g., 3 mm), after which the gap may, preferably, be filled by a filler, such as caulk, silicone, or the like.

From the above, one skilled in the art will appreciate that the preferred embodiments provide an improved glass header system. Note also that the preferred embodiment materials and configuration allow both a simplified and quick construction of generally vertical standing glass panes, retained in place in part by a header system as described. Through the use of this new header system, the installation process is sped up dramatically, the misalignment of glass panels is eliminated, extraneous noises are eliminated and multiple pieces are eliminated, further speeding up the installation process and reducing costs. Further adaptations will be readily ascertainable by one skilled in the art, given still additional considerations. Thus, while the inventive scope has been demonstrated by certain preferred embodiments, one skilled in the art will appreciate that it is further subject to various modifications, substitutions, or alterations, without departing from that inventive scope. For example, while certain dimensions and shapes have been provided, alternatives may be selected. Thus, the inventive scope is demonstrated by the teachings herein and is further guided by the following exemplary but non-exhaustive claims.

What is claimed is:

1. Apparatus for retaining a glass panel, comprising:

an anchor member for attaching to a wall and comprising a plurality of protrusions, including a channel between at least some of the protrusions and wherein the channel receives and retains an edge of the glass panel in a fixed position; and a header member having an end for fitting into abutment to the plurality of protrusions of the anchor member and enveloping a majority of the anchor, the header member further including a channel for retaining the edge of the glass panel.

2. The apparatus of claim 1 wherein the anchor member comprises a single aperture for receiving a fastener for retaining the anchor member to the wall.

3. The apparatus of claim 2 wherein the anchor member comprises:

a flat surface for abutting the wall and having the single aperture; and at least three protrusions extending away from the flat surface, the protrusions for fitting into abutment in the end of the header member.

4. The apparatus of claim 3:

wherein an end of the header member comprises a plurality of interior cavities; and wherein each of the at least three protrusions is for fitting into a respective fixed position in a respective one of the plurality of interior cavities in the end of the header member.

5. The apparatus of claim 2:

wherein the fastener comprises a screw; and wherein the aperture is for receiving the screw for a portion of the screw to pass through the aperture in approximately ninety-degree orientation to the wall and such that a portion of the screw, after passing through the aperture, penetrates the wall.

6. The apparatus of claim 1 wherein the channel of the header member comprises stiffening members extending inward into the channel of the header member.

7. The apparatus of claim 1 wherein the channel of the header member comprises stiffening members integrated into the header member and extending inward into the channel of the header member for coupling directly to the glass panel.

8. The apparatus of claim 7 wherein the stiffening members extend at an acute angle inward into the channel of the header member.

9. The apparatus of claim 1 wherein the header member comprises polycarbonate.

10. The apparatus of claim 1 wherein the header member comprises a height no greater than one inch.

11. The apparatus of claim 1 wherein the header member comprises a first header member for coupling to the glass panel as a first glass panel and retaining the second glass panel in a fixed position relative to the first glass panel, and further comprising:

a second header member for coupling to a second glass panel; and an angle joining member for coupling the first header member to the second header member for orienting the first header member at a non-zero angle relative to the second header member.

12. The apparatus of claim 11 wherein the angle joining member is for coupling the first header member to the second header member for orienting the first header member at a ninety degree angle relative to the second header member.

13. The apparatus of claim 1 wherein the header member comprises a first header member, and further comprising a second header member, wherein each of the first header member and the second header member comprises a plurality of cavities, and further comprising:

a plurality of angle joining members, each for fitting within a respective cavity in at least one header member, wherein the plurality of angle joining members are for coupling the first header member to the second header member for orienting the first header member at a non-zero angle relative to the second header member.

14. The apparatus of claim 1:

wherein an end of the header member comprises a plurality of interior cavities; and wherein each protrusion in the plurality of protrusions is for fitting into a respective one of the plurality of interior cavities in the end of the header member.

15. A method for retaining a glass panel in a position, comprising:

first, affixing an anchor to a wall, wherein the anchor comprises a first channel into which an edge of the glass panel will extend;

second, positioning the glass such that an edge of the glass aligns into the first channel of the anchor; and third, abutting a header member to envelop protrusions of the anchor and aligning a second channel in the header member with the edge of the glass.

16. The method of claim 15 wherein the step of abutting the header member to the anchor comprises sliding protrusions of the anchor into respective fixed positions in respective cavities of the header member.

17. The method of claim 15 wherein the step of aligning a second channel in the header member with the edge of the glass comprises friction fitting members in the second channel to a first and second side of the glass.

18. The method of claim 15 wherein the step of affixing an anchor to a wall comprises:

locating a surface of the anchor against a wall; and affixing a fastener through the surface of the anchor and into a fixed position relative to the wall.

19. The method of claim 18:

wherein the surface has a single aperture; and wherein the affixing step affixing a fastener through the surface comprises affixing a fastener through the single aperture.

20. The method of claim 15:

wherein the anchor comprises a plurality of protrusions;

wherein an end of the header member comprises a plurality of interior cavities; and wherein the third step further comprises abutting each protrusion in the plurality protrusions into a respective one of the plurality of interior cavities in the end of the header member.

* * * * *